United States Patent [19]

Matsumoto et al.

[11] 3,930,850

[45] Jan. 6, 1976

[54] PROCESS FOR ELECTROPHOTOGRAPHIC COPYING BY TRANSFER OF ELECTROSTATIC IMAGES

[75] Inventors: Shoji Matsumoto, Neyagawa; Hitoshi Nishihama, Hirakata; Tatsuo Aizawa, Osaka, all of Japan

[73] Assignee: Mita Industrial Company, Ltd., Osaka, Japan

[22] Filed: July 31, 1973

[21] Appl. No.: 384,294

[30] Foreign Application Priority Data

July 31, 1972 Japan ..... 47-76575

[52] U.S. Cl. ..... 96/1 TE; 96/1 R; 96/1 C; 96/1.2; 317/262 A; 317/262 AE; 355/3 R; 355/4

[51] Int. Cl.[2] ..... G03G 13/18; G03G 13/01; G03G 13/22

[58] Field of Search ..... 96/1 R, 1 C

[56] References Cited

UNITED STATES PATENTS

| | | | |
|---|---|---|---|
| 2,879,395 | 3/1959 | Walkup | 96/1 C |
| 3,076,092 | 1/1963 | Mott | 96/1 C |
| 3,438,706 | 4/1969 | Tanaka et al. | 96/1 R UX |
| 3,464,818 | 9/1969 | Waly | 96/1 R X |
| 3,515,548 | 6/1970 | Lange | 96/1 R |
| 3,666,363 | 5/1972 | Tanaka et al. | 96/1 R X |
| 3,666,364 | 5/1972 | Marushima | 96/1 R X |
| 3,666,365 | 5/1972 | Tanaka et al. | 96/1 R X |
| 3,666,458 | 5/1972 | Arneth et al. | 96/1 TE |
| 3,676,117 | 7/1972 | Kinoshita | 96/1 R |
| 3,679,405 | 7/1972 | Makino et al. | 96/1.5 |
| 3,770,429 | 11/1973 | Kinoshita et al. | 96/1 R |
| 3,775,104 | 11/1973 | Matsumoto et al. | 96/1 R |
| 3,830,645 | 8/1974 | Zweig | 96/1 R |
| 3,853,553 | 10/1974 | Yasuie | 96/1 R |

FOREIGN PATENTS OR APPLICATIONS

| | | | |
|---|---|---|---|
| 38-19791 | 9/1963 | Japan | 96/1 R |

*Primary Examiner*—David Klein
*Assistant Examiner*—John R. Miller
*Attorney, Agent, or Firm*—Sherman & Shalloway

[57] ABSTRACT

An electrophotographic process comprising forming an electrostatic image on the surface of a sensitive member, transferring the electrostatic image onto the surface of a transfer member, and developing the image so transferred. The process specifically involves using an overcoated sensitive member consisting essentially of an electrically conductive base, a photoconductive layer and a light-transmitting surface insulating layer, subjecting the sensitive member to a primary charging in a specific polarity using a direct current corona discharge, exposing light and dark images on the surface of the sensitive member and simultaneously subjecting it to a secondary charging until the surface of the sensitive member has the same polarity as in the primary charging and its potential becomes substantially equal to the untransferable upper limit potential, exposing the entire surface of the sensitive member to render the potential of the dark image area higher than the untransferable upper limit potential without substantially changing the potential of the light image area, transferring the electrostatic image so formed on the surface of the sensitive member to the surface of a transfer member, and then developing the electrostatic image so transferred thereby to form visible images.

5 Claims, 26 Drawing Figures

Fig. 1-A
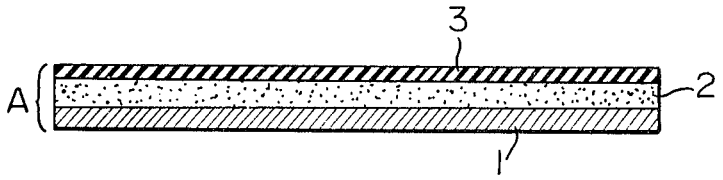
Fig. 1-B
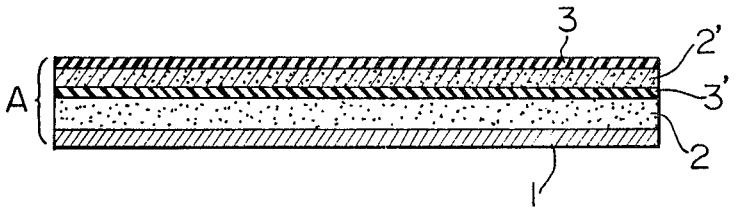
Fig. 1-C
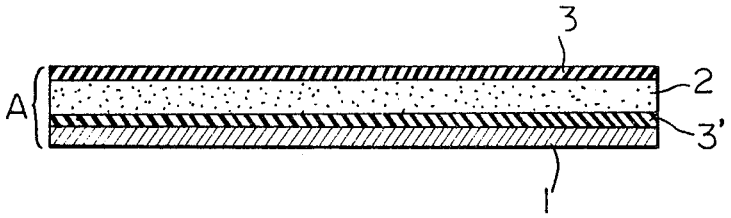

Fig. 2-A
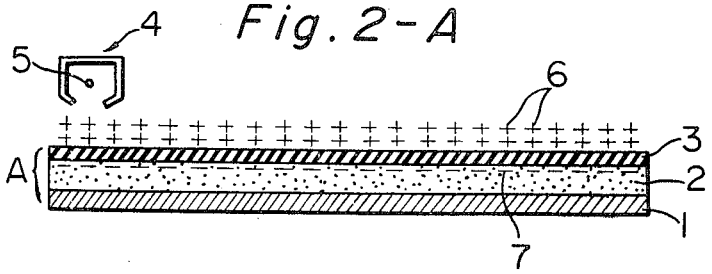
Fig. 2-B
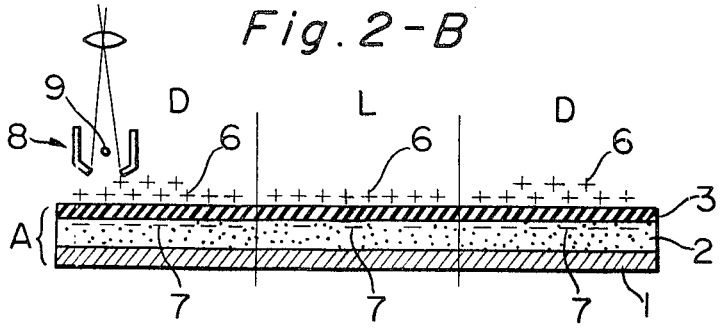
Fig. 2-C
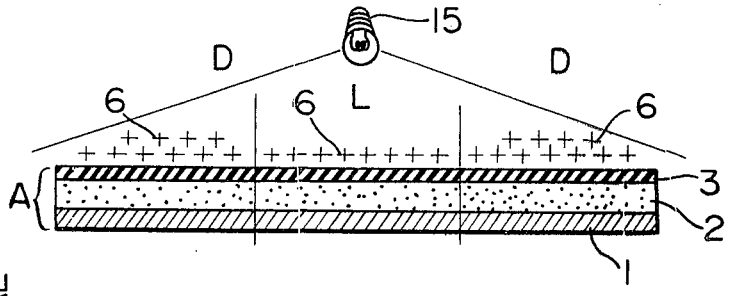
Fig. 2-D
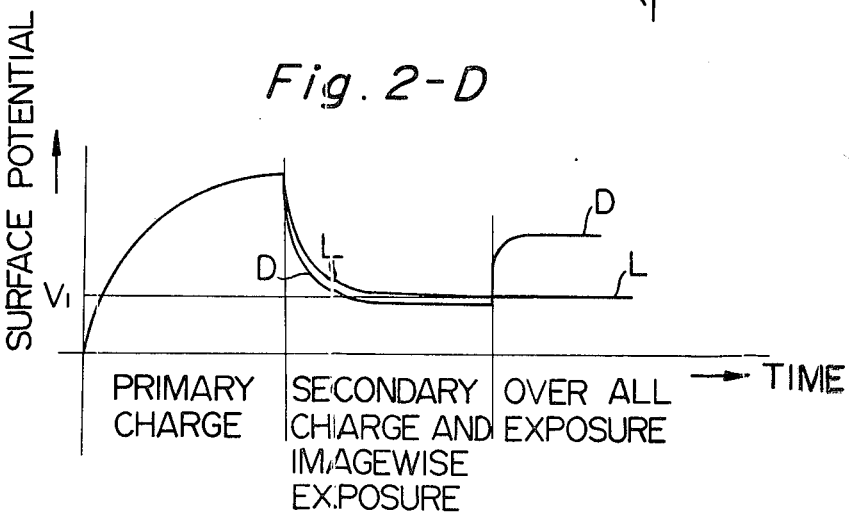

Fig. 3-A
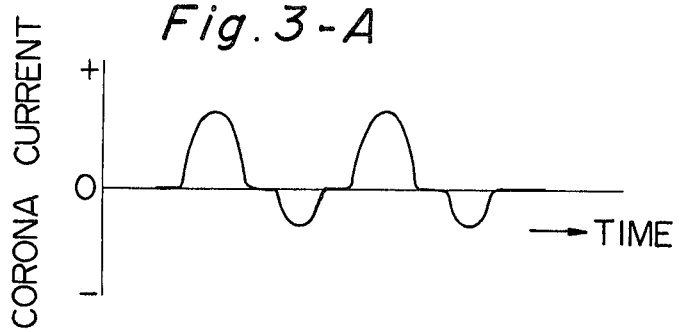
Fig. 3-B
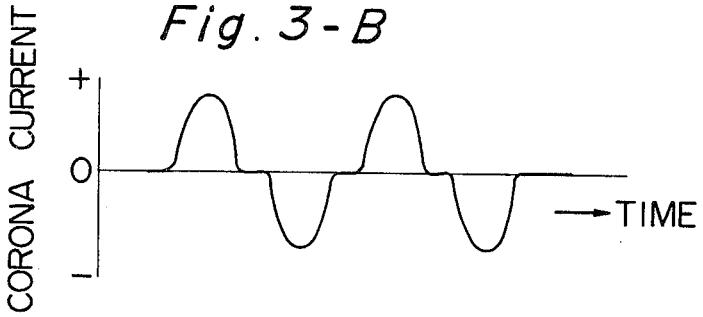
Fig. 3-C
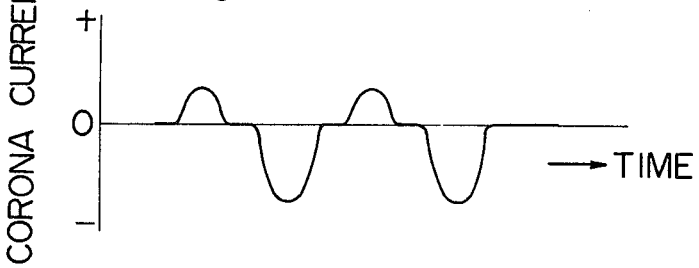

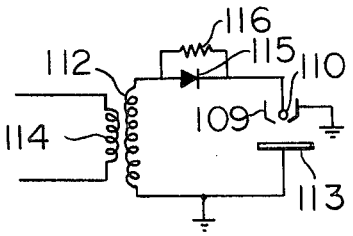
Fig. 4-A
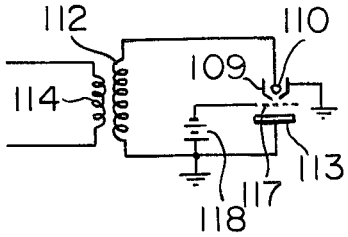
Fig. 4-B
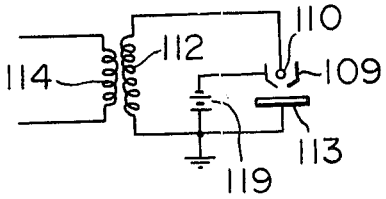
Fig. 4-C
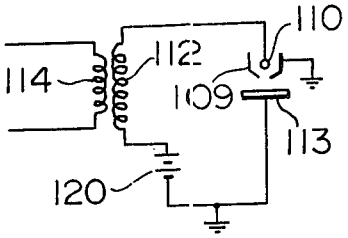
Fig. 4-D
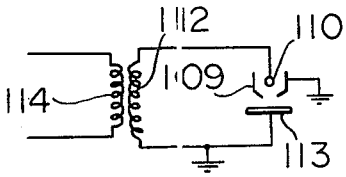
Fig. 4-E Fig. 5
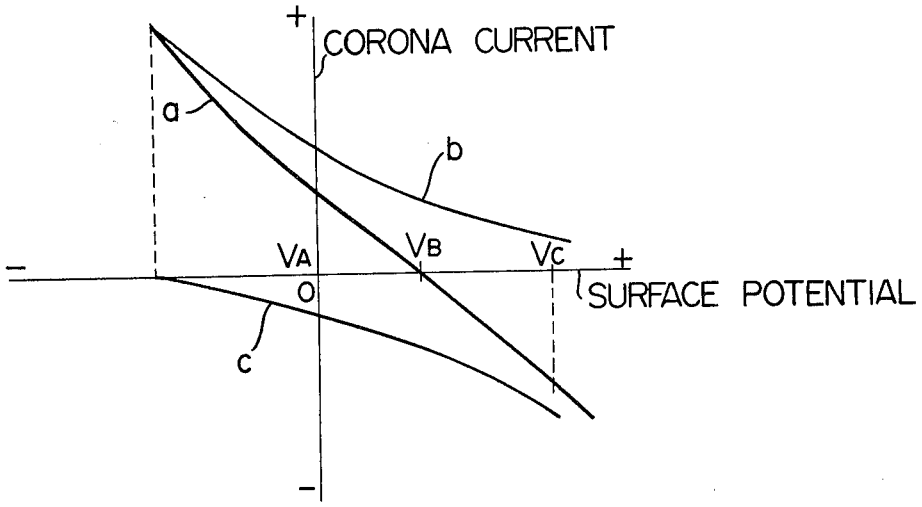
Fig.5-A
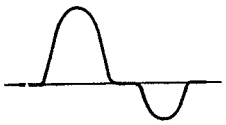
Fig.5-B
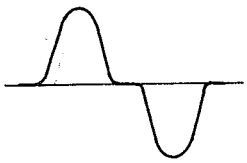
Fig.5-C
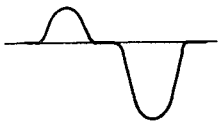

Fig. 6-A
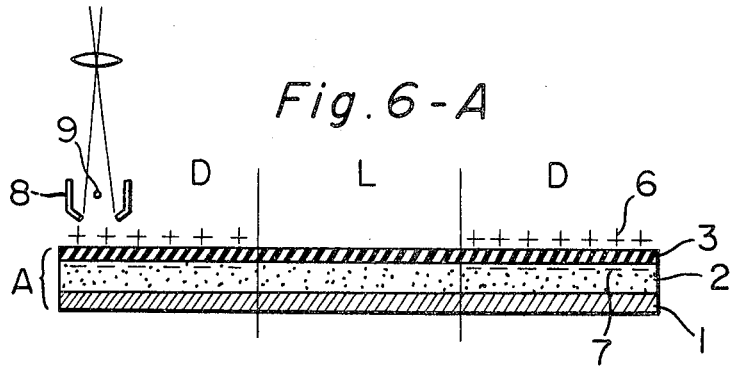
Fig. 6-B
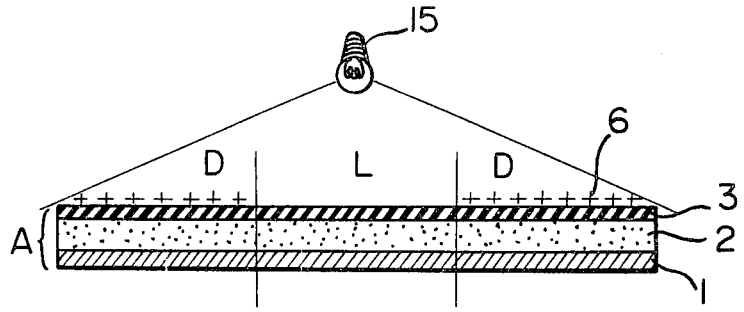
Fig. 6-C
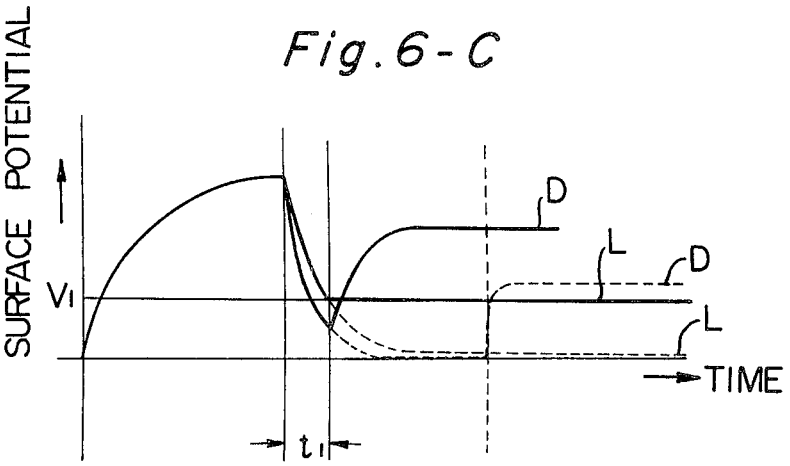

PROCESS FOR ELECTROPHOTOGRAPHIC COPYING BY TRANSFER OF ELECTROSTATIC IMAGES

This invention relates to a process and an apparatus for electrophotographic copying. More specifically, this invention relates to a process of electrophotographic copying which comprises forming electrostatic images on the surface of an overcoated sensitive member, transferring the electrostatic images to the surface of a transfer material, and developing the transferred electrostatic images to form images, and an apparatus for use in this process.

Various processes called the TESI method (Transferring of Electrostatic Image) have been known as a transfer process for electrostatic images (R. M. Schaffert, "Electrophotography", May 1965, The Focal Press). There are two typical processes of this kind.

a. Process wherein a transfer material such as insulating film is placed near the surface of a sensitive element on which electrostatic images have been formed, and a direct current voltage (500 to 1,000 volts) is applied between the back surface of the sensitive member and the back surface of the transferring film, thereby to transfer the electrostatic images.

b. Process wherein a transferring film whose back surface has been uniformly charged in advance is brought into contact with, or brought near, the surface of a sensitive member on which electrostatic images have been formed, thereby to transfer the electrostatic images.

Thus, in accordance with the TESI method, an electric potential difference is established in some form between the sensitive member and the transfer material, and therefore, electrostatic images of low potential can also be transferred. However, since a step of providing an electric potential difference between the sensitive member and the transfer material is required, the apparatus becomes so much complicated.

Generally, by mere contacting of the transfer material with the sensitive, member, electrostatic images having less than a given potential cannot be transferred. The upper limit of the potential which does not permit transfer by mere contacting (to be referred to as "untransferable upper limit potential") differs according to the transfer material, but generally ranges from 300 V to 400 V. Furthermore, in order to obtain images of practical utility, the electrostatic images must have a potential contrast of at least 100 V. In order that electrostatic images having a contrast of at least 100 V are formed on the surface of the transfer material by transfer, the original electrostatic images as formed on the surface of the sensitive member should have a potential contrast of at least 400 V, preferably at least 600 V.

Japanese Patent Publication No. 13190/68 discloses a method which involves forming electrostatic images having high electric potential and high potential contrast, transferring the electrostatic images by merely bringing the transfer material into contact with the surface of the sensitive material, and then developing the transferred images. According to this method, an overcoated sensitive member composed of an electrically conductive layer, a photoconductive layer, and an insulative surface layer is primarily charged with a direct current corona discharge of a specific polarity, and then secondarily charged with a direct current corona discharge of an opposite polarity to the primary charging while simultaneously light and dark images are exposed to the sensitive member. Thereafter, the surface of the sensitive member is uniformly exposed to form electrostatic images of an opposite polarity to the primary charging. The electrostatic images so formed have an opposite polarity to the primary charging, and the light non-image area has a higher potential than the dark image area. The electrostatic images are transferred to the transfer material, and then developed. However, since the potential of the light non-image is higher than that of the dark image area, positive images cannot be obtained by normal development (a method whereby a toner charged in an opposite polarity to the polarity of the higher potential area is adsorbed onto the higher potential area, thereby to effect development). Accordingly, in the above-mentioned process, a toner charged in the same polarity as the electrostatic images is used, and by utilizing the electrical repelling action of a part corresponding to the light non-image area, is adhered to a part corresponding to the dark image area (repulsive developing method).

According to the repulsive development method, however, it is difficult to adhere a toner uniformly over a wide area because of an edge effect. Since the adhesion of the toner is based on the repulsive force of the higher potential area, its adhesive strength is weak. The adhesion of the toner is further weakened because before and/or after the development step, the electric charge of the higher potential area of electrostatic images is partly eliminated or leaked by the contact of rollers, etc. As a result, the toner has difficulty of adhering to the surface to be developed, and even when it has adhered thereto it is liable to be removed during passage between rollers. This defect has precluded it from practical use.

It has now been found that by using an overcoated sensitive member and choosing the wave form of corona discharge in the secondary charging and/or the charging time properly, there can be formed on the surface of the laminated sensitive material electrostatic images which have the same polarity as the primary charging, and in which the potential of the light non-image area is substantially equal to, or lower than, the untransferable upper limit potential, and the potential of the dark image area is high enough beyond the untransferable upper limit potential as to show sufficient potential contrast for development after transfer. When the electrostatic images so formed are transferred onto the transfer material, the potential of the light non-image area of the transferred electrostatic images is substantially zero, and the potential of the dark image area is about 100 V or above. The electrostatic images on the transfer material can be developed by utilizing electric absorptive force with toner particles charged in an opposite polarity to the polarity of the electrostatic images. As a result, positive images of good quality can be obtained.

For example, according to one embodiment of the present invention, electrostatic images with a light non-image portion having an electric potential of about 400 V and a dark image portion having an electric potential of about 1000 V are formed on the surface of a sensitive member, and by contacting a transfer material to the surface of the sensitive member, the electrostatic images are transferred to the surface of the transfer material. As a result, in the electrostatic images formed on the surface of the transfer material the potential of the light non-image area is substantially zero, and the potential of the dark image area becomes about 100 V or higher.

According to the present invention, there is provided an electrophotographic process, which comprises primarily charging the surface of an overcoated sensitive member to a specific polarity, said sensitive member being composed of an electrically conductive base, a photoconductive layer and a light-transmitting surface insulation layer, or alternatively a sensitive member in which an intermediate insulation layer is provided between said photo-conductive layer and said electrically conductive base; exposing light and dark images on the surface of the sensitive member primarily charged, or simultaneously or subsequently forming corona discharge between said electrically conductive base and an electrode spaced from the surface of said sensitive member by a suitable distance, thereby to effect secondary charging, activating the photoconductive layer of the sensitive member to substantially remove the charge formed on the interface between the surface insulation layer and said photoconductive layer, the wave form of corona discharge of the secondary charging and/or the charging time being such that after activation of the photoconductive layer, electrostatic images formed on the surface of the sensitive member have the same polarity as the primary charging, the potential of the light non-image area is substantially equal to the untransferable upper limit potential, and the potential of the dark image area is higher than the untransferable upper limit potential; transferring said electrostatic images to the surface of the transfer material and developing the electrostatic images transferred to the surface of the transfer material.

An object of this invention is to provide an improved process and apparatus for transferring electrostatic images formed on a sensitive member to a transfer material and then developing the transferred electrostatic images to form images. This process makes it possible to use an apparatus of simplified structure since it is not necessary to adhere a developer directly to the sensitive member or remove the toner remaining on the surface of the sensitive member after transfer of visible images, as compared with the method in which development is carried out on a sensitive member, and the formed visual images are transferred to a transfer paper. It also leads to increased durability of the sensitive member.

Another object of this invention is to provide a process whereby images can be transferred merely by bringing a transfer paper into contact with the surface of a sensitive member without applying voltage between the sensitive member and the transfer material or charging the back surface of the transfer material uniformly beforehand.

Still another object of this invention is to provide a process for forming an electrostatic image whose light non-image portion has a potential of substantially zero on a transfer material. As a result, by using a toner charged in an opposite polarity to the potential of the dark image area, images can be developed to give positive images of good quality.

A further object of this invention is to provide a process for forming on a transfer material images of high contrast which are free from fog or edge effects.

A still further object is to provide a color electrophotographic copying apparatus utilizing the above processes.

Other objects of this invention along with its advantages will become apparent from the following description taken together with the accompanying drawings in which:

FIGS. 1-A, 1-B and 1-C are sectional views showing the sectional structures of laminated sensitive materials for use in the present invention;

FIGS. 2-A, ,2-B and 2-C are views illustrating a primary charging step, a secondary charging step including the exposure of light and dark images and an alternate current corona discharge;

FIG. 2-D is a diagram showing the surface potential of an overcoated sensitive member in each of the steps shown in FIGS. 2-A, 2-B and 2-C;

FIGS. 3-A, 3-B and 3-C are diagrams showing the wave forms of corona discharge current in the secondary charging, FIG. 3-B showing the wave form of corona discharge current using a symmetric alternate current, and FIGS. 3-A and 3-C showing the wave forms of an asymmetric corona discharge current;

FIGS. 4-A, 4-B, 4-C and 4-D are circuits of an asymmetric corona discharge unit;

FIG. 4-E is a connection diagram of a symmetric alternate current corona discharge unit;

FIGS. 5, 5-A, 5-B and 5-C are views illustrating the relation between the surface potential and the wave form of corona discharge;

FIG. 6-A is a view illustrating the secondary charging step including the exposure of dark and light images and alternate current corona discharge;

FIG. 6-B is a view illustrating the case where this secondary charging is performed until an equilibrium state is reached;

FIG. 6-C is a diagram showing the surface potential of a sensitive member in each step;

Figure 7:
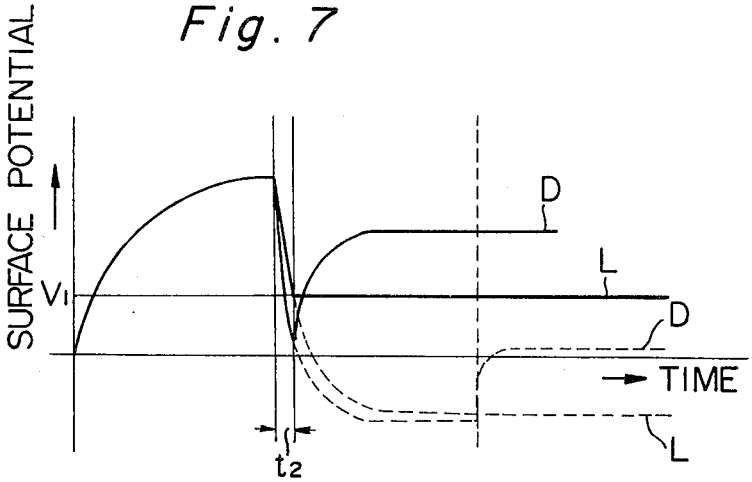
FIG. 7 is a diagram showing the surface potential of a sensitive member which has been subjected to the secondary charging using an asymmetric alternate current corona discharge of the wave form shown in FIG. 3-C.

The overcoated sensitive member used in this invention consists of 3 to 5 layers. In FIG. 1-A, a sensitive member A consists of an electrically conductive base 1, a photoconductive layer 2 formed on the base, and a surface insulation layer 3. Instead of providing a single insulating layer, an intermediate insulating layer may be provided between photoconductive layers, or between the photoconductive layer and the electrically conductive base. For example, as shown in FIG. 1-B, the sensitive material A consists of an electrically conductive base 1, a first photoconductive layer 2, an intermediate insulating layer 3', a second photoconductive layer 2', and a surface insulating layer 3. Or as shown in FIG. 1-C, the sensitive material A consists of an electrically conductive base 1, an intermediate insulating layer 3', a photoconductive layer 2, and a surface insulating layer 3. The photoconductive layer is known per se, and may be any desired material. For example, photoconductors or mixtures of photoconductors and binders are used as the photoconductive layer. Examples of the photoconductors that can be used for this purpose are inorganic photoconductive substances such as zinc oxide, cadmium sulfide, zinc cadmium sulfide, cadmium telluride (CdTe), selenium telluride (SeTe), cadmium selenide (CdSe), or antimony trisulfide ($Sb_2S_3$); organic photoconductive substances such as anthracene, anthraquinone or polyvinyl carbazole. There photoconductive materials can be directly used as the photoconductive layer. For example, selenium or cadmium sulfide is deposited from vapor on a suitable base, or a resin having photoconductivity, such as polyvinyl carbazole, is coated on a base, to form a photoconductive layer. Alternatively, it is possible to disperse a photoconductive material in a suitable binder, and then apply it to an electrically conductive base material. The binder may, for example, be an inorganic binder such as water glass or a resinous binder. Examples of the resinous binder are polymers or copolymers of styrene, polymers or copolymers of vinyl acetate, acrylic resins, polyvinyl acetal or copolymers thereof, alkyd resins, polyester resins, silicone resins, epoxy resins, and synthetic rubbers. Suitable binders are disclosed, for example, in British patent specification No. 1,020,506.

In order to increase the photosensitivity of the photoconductive material, the photoconductive material may be treated with a sensitizing dye such as Rose Bengale, or Methylene Blue. Furthermore, prior to use, the photoconductive material may be activated with a metal such as gold, copper, etc. Also, in order to improve the pre-exposing effect, dark resistance, etc. of the photoconductive layer, the photoconductive material may be surface treated with a Lewis acid, a fatty acid, or a metal salt of a fatty acid, or an organophosphate compound.

Examples of the electrically conductive material which supports the photoconductive layer are metal bases such as aluminum, copper or zinc, or base coated with metal-deposited or plated resins, electrically conductive resins, hygroscopic salts, or electrically conductive substances.

The base may be a flat plate or a cylindrical material. The insulation layer is suitably a film of a light-transmitting dielectric having high dielectric strength, for example, a polyester, cellulose ester, polystyrene or polyolefin.

Now, the description will be directed to a process of forming on the surface of a sensitive member an electrostatic image in which the potential of a light non-image area is substantially equal to the untransferable upper limit electric potential and the potential of a dark image area is sufficiently high for transfer and development.

The formation of such an electrostatic image requires the steps of primarily charging the sensitive member in a specific polarity, secondarily charging it simultaneously with the exposure of light and dark images, and then activating the photoconductive layer of the sensitive member by radiation.

First, the primary charging is carried out by a direct current corona discharge of a specific polarity (see FIG. 2-A). When the photoconductive material used in the photoconductive layer is an N-type semiconductor, it applies a positive discharge voltage to the corona electrode and gives a positive charge to the surface of the sensitive member. If it is a P-type semiconductor, it applies a negative discharge voltage to the corona electrode and gives a negative charge to the surface of the sensitive member. The corona discharge voltage of the primary charging differs according to the distance of discharge, that is, the distance between the surface to be charged and corona discharge electrode, and the kind of the photoconductor, but generally, it is desirably 5 to 10 KV. By this primary charging, an electric charge having an opposite polarity to the charge given to the surface of the sensitive member by the above charging extends to the interface between the surface insulation layer 3 and the photoconductive layer 2 through the photoconductive layer 2, and is built up there.

For example, when the photoconductive material is an N-type semiconductor, a positive charge 6 is uniformly given to the surface of the sensitive member by discharge from a corona discharge electrode 5 disposed within a charging device 4 as shown in FIG. 2-A. As a result, a negative charge through the photoconductive layer 2 is built up in the interface between the photoconductive layer 2 and the surface insulation layer 3.

Then as shown in FIG. 2-B, the light and dark images of the original are exposed by an exposing device onto the primarily charged sensitive member, and at the same time, subjected to a secondary charging by an ordinary alternate current corona discharge or an alternate corona discharge having an asymmetric current wave form using a corona discharge electrode 9 disposed in the charging device 8. Desirably, this secondary charging and the exposure are performed simultaneously. However, when change of the photoconductive material from the light resistance to the dark resistance is not rapid, it is not altogether necessary to perform them simultaneously, but the secondary charging may be effected after exposure.

After the end of the secondary charging, the photoconductive layer 2 beneath the surface insulation layer is activated by the method to be described. This causes the dark image area (D) of the photoconductive layer 2 to change also to an electrically conductive layer, and the charge 7 on the interface between the photoconductive layer 2 and the surface insulating layer 3 substantially disappears, whereupon the potential becomes substantially the same as the potential of the electrically conductive base (ground potential). As shown in FIG. 2-C, the activation of the photoconductive layer 2 is performed by exposing the entire surface of the sensitive member by a light source 15, or exposing the sensitive member to a bright place, or heating the photoconductive layer, thereby to impart a certain amount of energy to the photoconductive layer 2. Alternatively, the photoconductive layer can be activated by allowing the sensitive material to stand for a sufficient time to render the charge on the interface substantially extinct before the subsequent developing step. However, in view of the deterioration of the photoconductive material or the need for rapid repeated copying, it is desirable to perform the activation by exposing the entire surface of the sensitive member by the light source 15.

The potentials of the light non-image area and the dark image area of the electrostatic image so formed are determined by the wave form of corona discharge in the secondary charging and/or the charging time.

First, the description is directed to the case where the secondary charging is performed by using an asymmetric alternate current corona discharge in which the electric current component of the same polarity as that of the primary charging (positive in the case of FIG. 3-A) tends to be greater than the electric current component of the opposite polarity. Incidentally, as will be described in greater detail later on, the wave form of the current of corona discharge varies according to the potential of the surface of the material to be charged, and therefore, it will be referred to as a symmetric or an asymmetric alternate current with the wave form of discharge current on the surface having a potential of zero being taken as a standard.

An asymmetric alternate current corona discharge having a current wave form shown in FIG. 3-A is applied to the surface of the sensitive member which has been positively charged by the primary charging, at the same time as the exposing of the light and dark images (see FIG. 2-B). As a result, the positive charge on the surface of the sensitive member A is partly cancelled, and the surface has a certain positive potential determined by the asymmetricity of the corona discharge. Thus, when the exposing of the light and dark images and the secondary charging are completed, the surface potential of the sensitive member A is a substantially constant positive value both at the light and dark areas. The state of distribution of the charge of the sensitive member differs between the light non-image area L and the dark image area D as shown in FIG. 2-B. In the light non image area L the negative charge 7 built in the interface between the photoconductive layer 2 and the surface insulating layer 3 is freely movable. Accordingly, the positive charge 6 on the surface and the negative charge 7 in the interface disappear at the same rate as the secondary charging is carried out, and reach an equilibrium when the surface potential of the sensitive member A becomes the above-mentioned constant positive electric potential. In the dark image area D, the resistance of the photoconductive layer 2 has a large resistance, and therefore, the negative charge 7 of the interface does not easily disappear. The electric charge in the interface is maintained substantially in this state, and the positive charge 6 on the surface is slightly neutralized and reaches the positive equilibrium potential as described above. Accordingly, a greater amount of positive charge 6 remains in the dark image area D than in the light non-image area L. This equilibrium potential is determined from the negative charge 7 remaining in the interface and the positive charge 6 remaining unneutralized on the surface.

Thus, after the end of the secondary charging, the entire surface of the sensitive member A is uniformly exposed as shown in FIG. C. This results in the removal of the negative charge 7 in the interface between the photoconductive layer 2 beneath the dark image area D and the surface insulation layer 3, and in a rise in the potential of the dark image area D.

The change in the potential of the surface of the sensitive member in each of the above steps is shown in FIG. 2-D. The surface potential rises to a high positive potential by the primary charging, and by the secondary charging, decreases to a potential determined by the asymmetry of the corona discharge current, finally reaching the equilibrium potential. The potential of the dark image area D rises by the exposure of the entire surface, but the potential of the light non-image area L does not change. As is seen from this figure, the final potential of the light non-image area is substantially the same as the equilibrium potential after the secondary charging. By choosing the asymmetry of corona discharge current in the secondary charging so that the equilibrium potential is equal to the untransferable upper limit potential $V_1$, the potential of the light non-image area can be made to correspond with the untransferable upper limit potential. According to this process, even when the untransferable upper limit potential $V_1$ changes by the condition of the atmosphere at the time of transfer or the properties of the transfer material, the surface potential of the light non-image area L can be substantially made equal to the untransferable upper limit potential $V_1$ by adjusting the symmetry of the wave form of the asymmetric alternate corona discharge current.

The asymmetric alternate corona discharge used in the above process can be produced by any desired method. Examples of circuits for producing the asymmetric alternate discharge are shown in FIGS. 4-A to 4-D. For example, as shown in FIG. 4-A, one end of a high voltage transformer is connected to a corona discharge electrode 110 through parallel-connected rectifier 115 and resistance 116 as an impedance element, and the other end is connected to another electrode 113. The wave form of corona discharge current obtained by this operation is an asymmetric form in which the discharge current on the minus side is suppressed, and the corona discharge current on the plus side is substantially not suppressed as shown in FIG. 3-A. By choosing the value of the resistance 116 connected in series to the rectifier 115 and the polarity of the rectifier 115, the amount of the discharge electric current of a certain polarity can be adjusted to a desired value.

Or as shown in FIG. 4-B, a control grid 117 is provided between the corona discharge electrode 110 and the other electrode 113, and by applying a direct current voltage to this control grid from a direct current source 118, the discharge current of a certain polarity can be restrained. In this case, also, the wave form of corona discharge becomes asymmetric as shown in FIG. 3-A. By controlling the voltage to be applied to the control grid 117, the asymmetry of the current wave form can be adjusted. Instead of providing a control grid between the corona discharge electrode 110 and the other electrode 113, it is possible to connect an open shield 109 provided in proximity to the discharge electrode 110 to the direct current source 119, as shown in FIG. 4-C, and a direct current voltage is applied thereto to restrain discharge current of a certain polarity and to obtain an alternate corona discharge current of an asymmetric wave form as shown in FIG. 3-A.

Furthermore, as shown in FIG. 4-D, one end of a secondary side 112 of the high voltage transformer is grounded through the direct current electric source 120, and the other end is connected to the corona discharge electrode 110 and the electrode 113 is earthed. This makes it possible to apply a direct current bias voltage, and an alternate corona discharge current of the asymmetric wave form as shown in FIG. 3-A can be obtained.

The relation between the wave form of the corona discharge current and the surface potential of the member to be charged will be described by referring to FIG. 5.

FIG. 5 is a graph showing the relation between the surface potential and the corona discharge current showing the wave form shown in FIG. 5-A with respect to the surface having a potential of zero. The surface potential is plotted on the axis of abscissas and the current on the axis of ordinates. Line *b* shows the charging current of a positive component of the alternate current corona discharge, line *c* the current of a negative component, and line *a* the difference between the positive current and the negative current. As is clearly seen from FIG. 5, when the surface potential is positive, the component of the corona current on the positive side is suppressed, and the current on the negative side is increased. For example, when the sensitive member charged to the surface potential $V_c$ by the primary charging is subjected to an asymmetric alternate current corona discharge, the wave form of the corona discharge current takes the form as shown in FIG. 5-C, in which the negative current becomes greater than the positive current. As a result, the positive charge on the surface of the sensitive material is gradually cancelled, and the potential decreases. When the potential of the surface of the sensitive material reaches $V_B$, the wave form of the corona discharge current takes the form shown in FIG. 5-B in which the positive current is equal to the negative current. Thus, the charge on the surface of the sensitive material is no longer cancelled, and the surface potential is maintained at $V_B$. In other words, when the secondary charging is carried out using an asymmetric alternate corona discharge mentioned above, the surface potential of the sensitive material reaches an equilibrium at $V_B$. Thus, by making the equilibrium potential $V_B$ to correspond with the untransferable upper limit potential, the potential of the light non-image can be made equal to the untransferable upper limit potential. The equilibrium potential $V_B$ is substantially equal to the voltage of a bias electric source 118 of the control grid 117 in the device shown in FIG. 4-B, and corresponds with the voltage of a bias electric source 120 of a coil 112 (or the counter electrode 113) in the device shown in FIG. 4-D.

Next, the description will be directed to the case of performing the secondary charging for a predetermined time using a symmetrical alternate current corona discharge shown in FIG. 3-B. As shown in FIG. 4-E, the symmetrical corona discharge can be produced from an ordinary alternate current electric source.

There has been known the following method in which an electrostatic image was formed by utilizing an alternate corona discharge as the secondary charging. As shown in FIG. 6-A, dark and light images are exposed onto the sensitive member positively charged by the primary charging, and simultaneously an alternate current corona discharge is appied thereto. Since the surface potential is positive, the discharge current on the positive side of alternate current corona discharge is suppressed, and the discharge current on the negative side is increased. Thus, only the negative charge reaches the surface and neutralizes the positive charge. When the positive charge of the surface is neutralized gradually, the potential of the surface approaches a zero potential. The suppressed discharge current on the positive side gradually increases, and the increased corona discharge current on the negative side gradually decreases. When the surface potential becomes zero, the discharge current on the positive side becomes equal to the discharge current on the negative side. The surface potential does not change further, but reaches an equilibrium. When exposure is effected on the entire surface as shown in FIG. 6-B, the negative charge 7 remaining beneath the dark image area D is removed, and the potential of the dark image area D is increased.

The change of the surface potential of the sensitive material in each step is shown by the dotted line in FIG. 6-C. According to such a conventional method, the surface potential of the light non-image area L becomes substantially zero, and on the other hand, the surface potential of the dark image area D is only somewhat higher than the untransferable upper limit voltage $V_1$. Thus, although there is sufficient contrast of potential between the light non-image area L and the dark image area D in the surface of the sensitive member, an electrostatic image transferred onto the transfer material by bringing the surface of the sensitive member into contact with the surface of the transfer material without applying a trnasfer voltage has a small contrast, and it is difficult to obtain good images.

In contrast, in the present invention, it is essential that the surface potential of the light non-image area L becomes substantially equal to the untransferable upper limit potential $V_1$. In order to achieve this end, it is necessary to adjust the time required of the secondary charging to the time duration $t_1$ shown in FIG. 6-C. In other words, it is important that the secondary charging is stopped when the potential of the light non-image area L gradually decays and reaches the untransferable upper limit potential $V_1$.

When exposure is performed uniformly all over the surface, the potential of the dark image area D rises, but the potential of the light non-image area L is still the untransferable upper limit potential $V_1$. Thus, by making the potential of the light non-image area L equal to the untransferable upper limit potential $V_1$, the potential of the dark image area can be maintained at a higher potential than $V_1$, and electrostatic images of high contrast can be transferred to the surface of a transfer material.

Next, the description will be directed to the case of performing the secondary charging using an asymmetric alternate current corona discharge showing a tendency that the current component having an opposite polarity to the polarity of the primary charging is greater than the current component of the same polarity as the polarity of the primary charging. As is shown by the dotted line in FIG. 7, the potentials of the light non-image area L and the dark image area D rapidly change to an opposite polarity to the polarity of the primary charging, as a result of the secondary charging. It is essential in the present invention that the potential of the light non-image area L is substantially equal to the untransferable upper limit potential $V_1$. Thus, it is necessary that the time required for the secondary charging be adjusted to the time duration $t_2$ shown in FIG. 7; in other words, the secondary charging be stopped when the potential of the light non-image area L reaches the untransferable upper limit electric potential $V_1$ on the same polarity side as the polarity of the primary charging. In this process, the time duration $t_2$ can be prolonged by making the voltage of the secondary charging lower than the primary charging. When exposure is performed uniformly on the entire surface after the secondary charging, the potential of the dark image area D rises as shown by the solid line in FIG. 7, and the potential of the light non-image L is still the untransferable upper limit potential $V_1$.

Figure 8:
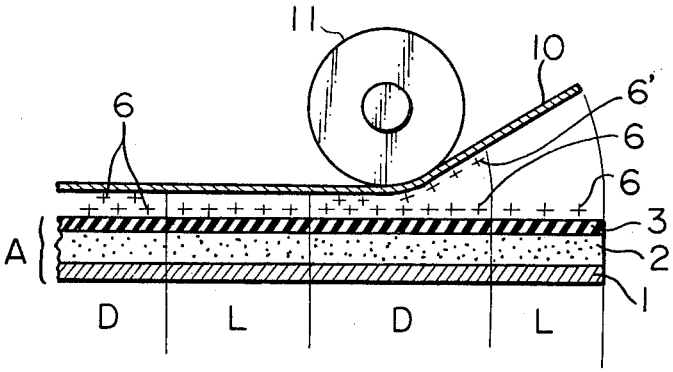
FIG. 8 is a view illustrating a step of transferring an electrostatic image to a transfer material in the process of this invention.

The electrostatic image formed on the surface of the sensitive member by the above methods, in which the potential of the light non-image area L is substantially equal to the untransferable upper limit potential $V_1$ and the potential of the dark image area D is higher than $V_1$, is then transferred onto the surface of a transfer material 10. For example, as shown in FIG. 8, the transfer surface of the transfer material 10 is brought into intimate contact with the surface of the surface insulating layer 3 which retains the electrostatic image, and a suitable pressure is applied thereto from the back surface of the transfer material 10 using a roller 11 for example. This ensures uniform intimate contact between the surface of the surface insulating layer 3 and the transfer surface of the transfer material 10. Then, the transfer material 10 is peeled off from the surface insulating layer 3. If at this time, the surface potential of the light non-image area L on the surface of the sensitive member is higher than the untransferable upper limit potential $V_1$, the charge is transferred to the surface of the transfer material 10, and this charge appears as fog by development. However, since the potential of the light non-image area L formed by the above-described method is equal to, or higher than, $V_1$, the charge of the light non-image area L is not transferred.

Since the surface potential of the dark image area of the surface of the sensitive member is higher than the untransferable upper limit potential $V_1$, the positive charge 6 of the dark image area D is divided, and part of it remains and part of it is transferred (positive charge 6'). The ratio of division varies according to the ratio of the capacity of the sensitive material A to that of the transfer material 10, the degree of intimate contact, the contact time, etc. When the capacity of the transfer material 10 is larger than that of the sensitive member A, the ratio of the transfer charge 6' generally increases.

The roller 11 which brings the transfer material 10 into contact with the sensitive member may be an insulator, but preferably it is constructed of an electrically conductive substance and grounded. If the electric conductivity of the roller 11 is large and the roller is grounded, the proportion of the transfer charge 6' increases as compared with the case where the roller 11 is not grounded.

The transfer material 10 may, for example, be a film of a polymer or copolymer of styrene, a polymer or copolymer of vinyl acetate, an acrylic resin, polyvinyl acetal or copolyvinyl acetal, a cellulose acetate resin, or a natural resin, or a paper coated with such a polymer or resin. More suitably, one surface of a film of the above resin is rendered electrically conductive using a metal, an electrically conductive resin, a paper coated or impregnated with a hygroscopic salt or an electrically conductive coating, or a mixture of metal powder and a resin, and the other surface is used as the transfer surface. The most widely used material of such a construction is a dielectric coated paper used for electrostatic image recording in a facsimile system for example. Even when this recording paper is directly used as a transfer paper, very good results can be obtained. The electrostatic charge formed on the surface of the transfer material 10 by the above method can be developed by a method known per se.

For the development process, a powdery or liquid developer can be used. The developing method may be any desired methods such as the magnetic brushing method, cascade method, powder cloud method, wet developing method, or mist developing method.

One embodiment of this invention will be described.

10 g of an acrylic resin was added to 90 g of cadmium sulfide activated with copper, and a small amount of a solvent was added. These were thoroughly mixed with each other to an extent such as not to destroy cadmium sulfide. The resulting viscous material was coated on a silver-deposited paper using a doctor knife in a thickness of about 100 microns to form a photoconductive coating. A polyethylene terephthalate (Mylar) film having a thickness of about 12 microns was overcoated on the surface of the photoconductive coating using an adhesive thereby to form a sensitive plate. As a primary charging, a positive discharge voltage of 7600 V was applied to an electrode and by corona discharge, the surface of the sensitive plate was uniformly charged. Then, simultaneously with the exposing of light and dark images, a 6700 V alternate current was applied to a tungsten wire having a diameter of about 0.08 mm through a rectifier (High Voltage Selen Rectifier HS 25/1, Fuji Denki Kabushiki Kaisha, Japan) and a resistance of 4 M Ω which are connected to each other in parallel, and a secondary charging was performed by means of corona discharge having an asymmetric current wave form such that the ratio of the positive component to the negative component of the corona discharge current with reference to the surface having a potential of zero is 5:4. Subsequently, the surface of the sensitive member was uniformly exposed. As a result, the potential of the surface of the sensitive member was + 450 V at the bright image area and + 900 V at the dark image area. The resulting electrostatic image was brought into intimate contact with an electrostatic recording paper (F-001, product of Tomoegawa Seishisho, Japan), and as shown in FIG. 8 of the accompanying drawings, a pressure is applied from the back surface of the electrostatic recording paper using a roller coated with an electrically conductive rubber having a volume resistivity of about $10^4$ ohms-cm. After this, the electrostatic recording paper was removed from the surface of the sensitive member to transfer the light and dark electrostatic image on the surface of the electrostatic recording paper. The electrostatic image so formed on the surface of the electrostatic recording paper had a surface potential of 0 V at an area corresponding to the light area of the original image and about + 100 V at an area corresponding to the dark area. The image was developed with a toner charged negatively, and then the electrostatic recording paper was passed between hot rollers coated with Teflon at its surface to fix the developed image. As a result, there was obtained a copied positive image having good contrast, superior stability and reduced edge effect, and being free from fog.

An example of an apparatus for performing repeated copying utilizing the process of this invention will be described with reference to FIG. 9.

Figure 9:
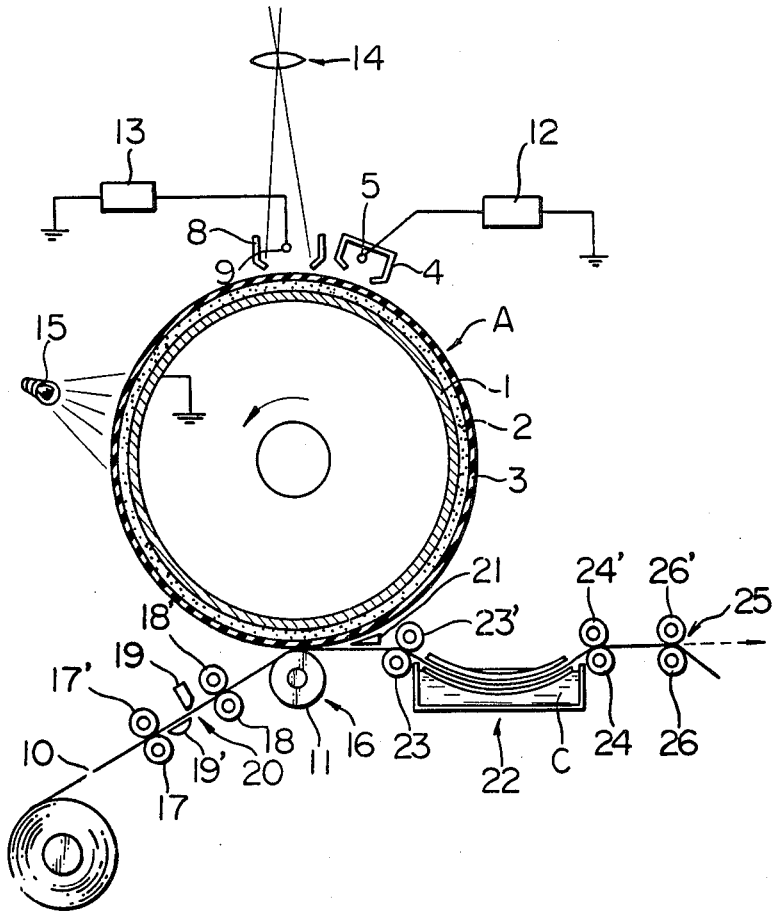
FIG. 9 is a view showing the arrangement of the individual units of a copying machine for use in performing the electrophotographic process of this invention.

Referring to FIG. 9, a sensitive drum A composed of a cylindrical electrically conductive base 1, an electrically conductive layer 2 and a surface insulating layer 3 rotates in the direction of the arrow, and successively passes the treating zones arranged around the drum. The electrically conductive base 1 is grounded. First, the surface of the insulating layer 3 is primarily charged by a positive or negative direct current corona discharge by means of a corona discharge device 4 having a discharge electrode 5 connected to a direct current electric source 12. Then, it undergoes a symmetric or asymmetric alternate current corona discharge by means of a corona discharge device 8 juxtaposed with the corona discharge device 5 and having a discharge electrode 9 connected to a symmetric or asymmetric alternate current electric source 13. Simultaneously, the sensitive member is exposed imagewise by an exposing device 14. Subsequently, it is uniformly exposed by a light source 15. As a result, there is formed on the surface 3 of the sensitive drum a light and dark electrostatic image having the same polarity as the polarity of the primary charging with the potential of the light non-image area being substantially equal to the untransferable upper light potential and the potential of the dark image area being higher than it. The electrostatic image reaches a transferring zone 16 according to the rotation of the sensitive drum A.

When the sensitive material has such a property that an electric charge between the photoconductive layer 2 and the surface insulating layer 3 becomes extinct relatively rapidly, it is not necessary to provide the light source 15. This is because the charge remaining between the photoconductive layer 2 and the surface insulation layer 3 becomes extinct by the time the sensitive drum reaches the transfer zone 16 from the corona discharge device 8.

On the other hand, the transfer material 10 is cut to a desired length by a cutting device 20 compound of a fixed blade member 19 and a rotating blade member 19′ located between a pair of feed rollers 17 and 17′ and a pair of feed rollers 18 and 18′, and then transferred to the transferring zone 16. It is then urged by an electrically conductive rubber roller 11 against the surface 3 of the sensitive drum on which the bright and dark electrostatic image has been formed. This results in the transfer of the electrostatic image to the transfer material 10. Depending upon the surface potential of the drum, the properties of the transfer material 10, or the speed of transfer, etc., a plurality of transfer rollers may be provided about the drum, or belts may be used instead of the rollers.

The transfer material 10 on which th electrostatic image has been transferred is removed from the drum surface 3 by means of a releasing plate 21, and then fed into a developing zone 22 by a pair of feed rollers 23 and 23′. The electrostatic image transferred onto the transfer member 10 is developed with a liquid developer C containing a toner charged in an opposite polarity to that of the electrostatic image.

Thus, in the apparatus used in this invention, it is not necessary to adhere a developing agent to the sensitive drum as in a copying apparatus of the type wherein a developer is applied to an electrostatic image on the sensitive drum. Accordingly, a device for cleaning the drum is not required, but the drum can be used in the next cycle after removing the residual electrostatic image or without removing it, after the transfer of the electrostatic image.

After development, the transfer material 10 is transferred to a suitable drying or fixing device 25 by means of a pair of rollers feed (concurrently acting as squeeze rollers) provided on the discharge side of the developing zone 22, and the toner image is fixed to the transfer material 10. The fixing device 25 consists, for example, of a pair of heated rollers 26 and 26′ one or both of which are heated. Preferably, the surface of the rollers which is brought into contact with the image is coated with an offset preventing material such as Teflon. This makes it possible to prevent a decline in the density of the image as a result of offsetting of the toner image onto the roller 26′ at the time of fixation.

In order to prevent the curling of the transfer material 10, it is preferred that the transfer material 10 be advanced in a straight line before and after the rollers 26 and 26′ or in the curved state with the image surface being convex outwardly.

In the fixation of the toner image, not only the toner is softened by heat and melt-adheres to the transfer material 10, but also the resin coated on the surface of the transfer material 10 is softened by heat to render the toner tacky. Accordingly, the fixing ability of the toner image is very superior.

By the above-described apparatus, a copied positive image of an original image having clear contrast and being free from fog can be obtained without applying a transfer voltage or without using reversal development.

Figure 10:
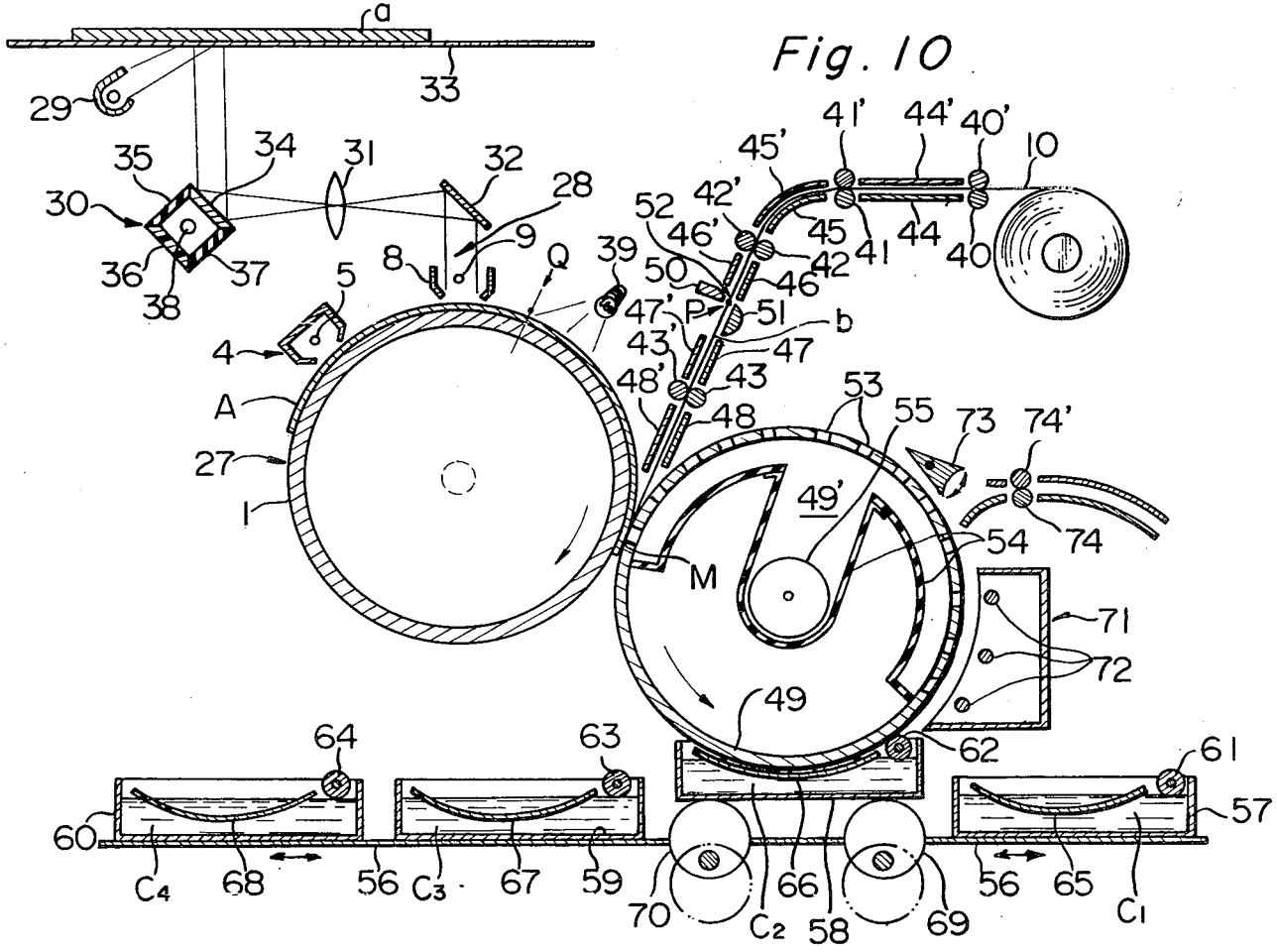
FIG. 10 is a view showing the arrangement of the individual units of a color copying machine for applying the electrophotographic process of this invention to color copying.

The process of the present invention can be applied to a color copying apparatus of the type shown for example in FIG. 10. Referring to FIG. 10, a sensitive member A is bonded to the surface of a cylindrical electrically conductive drum 1 to form a sensitive drum 27. When the sensitive member A includes one photo conductive layer as shown in FIGS. 1-A and 1-C, it is preferred to use a photoconductive material having sensitivity to light of a wide range of wavelengths, such as selenium telluride, as a photoconductive layer. Where there are two sensitive layers (as shown in FIG. 1-B), photoconductive materials of different sensitivities are used as sensitive layers 2 and 2′ to form a sensitive material which on the whole has a side range of sensitivity. For example, there can be employed a layer comprising a sensitive layer 2′ consisting of a mixture of 95% of selenium and 5% of arsenic, and a sensitive layer 2 consisting of cadium sulfide activated with copper. The sensitive layer 2′ and the intermediate layer 3′ are suitably made of a material which is substantially transparent with respect to light to which the sensitive layer 2 has sensitivity.

The sensitive drum 27 rotates in the direction of the arrow, and successively passes the treating zones arranged around the drum 27. First, the sensitive member A is primarily charged positively or negatively by a corona discharge electrode 5 provided within a corona discharge device 4. Then, it undergoes a secondary charging of a symmetrical or asymmetric alternate current corona discharge by means of a corona discharge device 8 juxtaposed with the corona discharge device 4 including a discharge electrode 9 connected to a symmetric or asymmetric alternate current electric source. At the same time, by an exposing device consisting of a light source 29, a color separation reflecting mirror 30, a lens 31 and a reflecting mirror 32, an optical image of original *a* subjected to color separation is irradiated from an opening 28. The color separation reflecting mirror 30 consists of a green reflecting mirror 34, a blue reflecting mirror 35, a red reflecting mirror 36 and a whole color reflecting mirror 37, and these reflecting mirrors are adapted to rotate about a rotating shaft 38. The reflecting mirror 32 is a whole color reflecting mirror.

The sensitive member A is then exposed all over its surface using a light source 39, and there is formed on the surface of the sensitive member A a light and dark electrostatic image having the same polarity as the polarity of the first charging with the potential of the light non-image area being substantially the same as the untransferable upper limit electrode and the dark image area being higher than it. When the sensitive material has such a property that an electric charge between the photoconductive layer and the surface insulating layer becomes extinct relatively rapidly, it is not necessary to provide the light source 39. This is because the charge remaining between the photoconductive layer and the surface insulation layer becomes extinct by the time the sensitive drum reaches the transfer zone M from the corona discharge device 8.

The transfer material 10 passed through a transfer passageway *b* formed by a group of feed roller pairs 40, 40′, 41 41′, 42, 42′ and 43, 43′, and a group of guide plates 44, 44′, 45, 45′, 46, 46′, 47, 47′ and 48, 48′, and sent to contact point M between the sensitive drum 27 and transfer drum 49. A cutting device 52 composed of a fixed blade member 50 and a rotating blade member 51 is provided in the transfer passageway *b*. The transfer material 10 is cut to a desired length according to the length of the original *a*.

The transfer material feeding mechanism is controlled so that the leading edge of the transfer material 10 begins to be fed from the cutting position P when the copying start point of the sensitive member A reaches the position Q which is apart from the contact point M in the opposite direction to the rotating direction of the drum by a distance equal to the distance between the contact point M and the cutting position P.

A transfer drum 49 has the same peripheral length as the peripheral length of the sensitive drum 2, and is rotated synchronously with the sensitive drum 27. A plurality of small holes 53 are provided on a part of the periphery of the transfer drum 49. On the inside of the transfer drum 49, a chamber 49′ consisting of a partition wall 54 is provided. Air is sucked from the small holes 53 by means of a fan provided within the chamber 49′. This suction force serves to remove the transfer material 10 from the sensitive member A at the position of the contact point M, and transfer it to the transfer drum. After transfer, the sensitive member A is repeatedly subjected to the above-described step in order to form a different light and dark electrostatic image by light rays subjected to color separation. On the other hand, the transfer material 10 sucked to the transfer drum 49 is then sent to a developing zone.

The developing zone consists of a moving station 56 and placed thereon developing tanks 57, 58, 59 and 60 which contain developer solutions $C_1$, $C_2$, $C_3$ and $C_4$ respectively for developing the image in different colors. The developing tanks 57 to 60 include squeeze rollers 61, 62 63 and 64 and developing electrodes 65, 66, 67, and 68. The moving station 56 is adapted to move in the direction of the arrow in response to the rotation of the color separation reflecting mirror 30, and transfer the developing tanks which contain developer solutions corresponding to the respective color separated light rays to the developing positions. Cams 69 and 70 lift the devloping tanks so that the surface of the transfer material 10 sucked to the transfer drum 49 becomes soaked in the developer solutions. At this time, the squeeze rollers are urged against the transfer drum 49 to squeeze an excess of the developer solution on the surface of the transfer material 10. On completion of the development, the developing tanks are caused to descend on the moving station 56 by the rotation of the cams 69 and 70. The moving station 56 is moved to the developing position in regard to the above color separation reflecting mirror 30.

Various modifications of the developing device are possible. For example, instead of lifting the developing tanks entirely, only the developing electrode and the squeeze rollers may be caused to approach the transfer material.

The developed transfer material 10 is sent to a drying or fixing device 71, and dried or fixed by a heater 72, after which it is again sent to the contact point M. The transfer material 10 which has arrived at the contact point M has transferred thereto the light and dark electrostatic image formed on the surface of the sensitive member A by color separated light rays different from that applied previously, and then the above-mentioned step is repeated.

When an electrostatic image is transferred again to the surface of the transfer material 10 which has once been developed, the properties of the transfer material 10 should not be changed greatly by the development before transfer.

The color separation and color reproduction of the color copying method in accordance with the present invention are as follows:

Suppose that the original *a* is made up of colors of black, red, green, blue, yellow, magenta, cyan and white, This original is irradiated with a light source 29 having an emission spectrum nearest to sunlight, such as a Xenon discharge lamp, to subject the reflecting light to color separation by means of the green reflecting mirror 34. The green reflecting mirror permits the transmission of the blue rays having a wavelength of about 400 to 500 m$\mu$ and red rays having a wavelength of at least about 570 m $\mu$, and mainly reflects green rays having a wavelength of 500 to 570 m $\mu$. Accordingly, only the green component of the reflecting lights ocrresponding to green, yellow, cyan and white among the colors of the original are reflected by the green reflecting mirror 34 and pass through the lens 31. They are further reflected by the whole color reflecting mirror 32, and the green light is irradiated onto the sensitive member A. Accordingly, an electrostatic image is formed in areas corresponding to black, red, blue and magenta. This electrostatic image is developed with a magenta developer solution $C_1$ contained in the developer tank 57, and dried or fixed.

To the transfer material 10 which has been developed with the magenta developer solution and dried or fixed is then transferred an electrostatic image formed by a blue light reflected by the blue reflecting mirror 35. The blue reflecting mirror permits the transmission of light of wavelengths of at least about 470 m$\mu$ and green and red rays, and reflects blue rays having a wavelength of less than about 470 m$\mu$. Accordingly, the electrostatic image is formed in areas corresponding to black, red, green and yellow. This electrostatic image is developed with a yellow developer solution $C_2$ contained in the developer tank 58.

To the transfer material 10 which has been developed with the yellow developer solution and dried or fixed is then transferred an electrostatic image formed by red rays reflected by the red reflecting mirror 36. This red reflecting mirror permits the transmission of blue and green light rays having a wavelength of not more than about 580 m$\mu$, and mainly reflects red rays having a wavelength of at least about 580 m$\mu$. Accordingly, only the red conponents of reflecting lights corresponding to red, yellow, magenta and white among the colors of the original are reflected by the red reflecting mirror 36, and then irradiated onto the sensitive member A. Accordingly, the electrostatic image is formed in areas corresponding to black, green, blue and cyan. This electrostatic image is developed with a cyan developer $C_3$ contained in the developer tank 59, and dried or fixed.

To the transfer material 10 which has been developed with the cyan developer and then dried or fixed is then transferred an electrostatic image formed by the whole color rays reflected by the whole color reflecting mirror 37. This electrostatic image is developed with a black developer solution $C_4$ of low concentration contained in the developer tank 60. The irradiation by this whole color reflecting mirror 37 and the black development can be omitted. The development may either be the wet or dry development. The dry development is especially suited for superposing transfer since the characteristics of the transfer material 10 are little changed by the developer.

By the repetition of the four transfer-development-fixation cycles, magenta, yellow, cyan and black are superposed on the surface of the transfer material in areas corresponding to the black portion of the original, and black is reproduced. Yellow and magenta are superposed on the surface of the transfer material in areas corresponding to the red portion, and red is reproduced. Cyan and yellow are superposed on the surface of the transfer material in areas corresponding to the green portion, and green is reproduced. Cyan and magenta are superposed on the surface of the transfer material in areas corresponding to the blue portion, and blue is reproduced. Only yellow is developed on the surface of the transfer material in an area corresponding to the yellow portion, and yellow is reproduced. Magenta and cyan are developed on the surface of the transfer material in areas corresponding respectively to magenta and cyan, and magenta and cyan are reproduced. Since the toner particles in the developer solutions do not adhere to an area of the surface of the transfer material which corresponds to the white portion, throughout the entire process, the white color of the transfer material 10 is reproduced as such.

When all of the above steps are completed and a copied color image is formed on the transfer material, a releasing device 73 acts to remove the transfer material 10 from the transfer drum 49, and discharged out of the machine by a pair of feed rollers 74 and 74'.

Clear copies free from fog can be obtained by applying the process of this invention as described above.

What we claim is:

1. An electrophotographic process which comprises 1. using an overcoated sensitive member consisting essentially of an electrically conductive base, a photoconductive layer and a light-transmitting surface insulating layer;
2. subjecting the surface of said overcoated sensitive member to a primary charging in a specific polarity;
3. exposing the surface of said overcoated sensitive member to an image having light and dark areas to produce on the surface of the charged sensitive member an electrostatic latent image corresponding to said light and dark image areas, and simultaneously or subsequently generating corona discharge current between said electrically conductive base and an electrode spaced from the surface of the overcoated sensitive member by a suitable distance, thereby to subject the overcoated sensitive member to a secondary charging;
4. then, uniformly exposing the entire surface of the overcoated sensitive member to activating light to substantially remove the charge formed on the interface between the surface insulating layer and the photoconductive layer;
5. transferring the electrostatic latent image to the surface of the charge retainable transfer material by bringing the surface of the transfer material into contact with the surface of the sensitive member without applying voltage between the sensitive member and the transfer member or charging the back surface of the transfer member uniformly beforehand; and
6. developing the electrostatic latent image transferred to the surface of the transfer material;

said process further characterized in that the corona discharge current of the secondary charging is an asymmetric alternating current in which a current component of the same polarity as the primary charging is greater than a current component of the opposite polarity, and its asymmetry is such that when the potential of the surface of th sensitive member as a result of the secondary charging has reached an equilibrium, its equilibrium potential is substantially equal to the untransferable upper limit potential whereby after the uniform exposure of step (4) the electrostatic image formed on the surface of the sensitive member has a potential in the light non-image area substantially equal to the untransferable upper limit potential and a potential in the dark image area higher than the untransferable upper limit potential.

2. The process of claim 1 wherein the potential of the dark image area of the electrostatic image formed on the sensitive member is at least 400 V higher than the untransferable upper limit potential.

3. The process of claim 1 wherein the time required for the secondary charging is the time required until the surface potential of the sensitive member becomes of the same polarity as the primary charging and becomes substantially equal to the transferable upper limit potential.

4. The process of claim 1 wherein said overcoated sensitive member further includes an intermediate insulating layer within the photoconductive layer.

5. The process of claim 1 wherein said overcoated sensitive member further includes an intermediate insulating layer between the photoconductive layer and the electrically conductive base.

* * * * *

UNITED STATES PATENT OFFICE

CERTIFICATE OF CORRECTION

Patent No. 3,930,850 Dated January 6, 1976

Inventor(s) MATSUMOTO, ET AL.

It is certified that error appears in the above-identified patent and that said Letters Patent are hereby corrected as shown below:

Column 18, line 30, delete "th", insert -- the --

Column 18, line 49, delete "transferable", insert
insert -- untransferable --

Signed and Sealed this

*thirtieth* Day of *March 1976*

[SEAL]

*Attest:*

RUTH C. MASON
*Attesting Officer*

C. MARSHALL DANN
*Commissioner of Patents and Trademarks*